United States Patent [19]

Czubak

[11] 4,346,534

[45] Aug. 31, 1982

[54] APPARATUS FOR HONING CYCLOIDAL SURFACES

[75] Inventor: Albin S. Czubak, Holland, Mich.

[73] Assignee: Ex-Cell-O Corporation, Troy, Mich.

[21] Appl. No.: 159,020

[22] Filed: Jun. 13, 1980

[51] Int. Cl.[3] ..... B24B 33/02; B24B 5/16

[52] U.S. Cl. ..... 51/34 A; 51/34 C; 51/90

[58] Field of Search ..... 51/34 R, 34 A, 35, 34 K, 51/50 R, 50 PC, DIG. 32, 101 R, 341, 348, 349, 34 C, 90

[56] References Cited

U.S. PATENT DOCUMENTS

| | | | |
|---|---|---|---|
| 2,110,756 | 3/1938 | Blood | 51/348 |
| 3,774,346 | 11/1973 | Hoglund | 51/90 |
| 3,812,574 | 5/1974 | Jones | 51/DIG. 32 |
| 3,822,511 | 7/1974 | Hoglund | 51/DIG. 32 |
| 3,922,819 | 12/1975 | Bender | 51/34 A |

FOREIGN PATENT DOCUMENTS

| | | | |
|---|---|---|---|
| 1958055 | 5/1971 | Fed. Rep. of Germany | 51/349 |
| 300746 | 11/1928 | United Kingdom | 51/341 |

*Primary Examiner*—Stephen G. Kunin
*Assistant Examiner*—Robert A. Rose
*Attorney, Agent, or Firm*—Edward J. Timmer; Frank D. Risko

[57] ABSTRACT

An apparatus for abrading and finishing the inner surface of an unusual shape, for example the inner ring of a gerotor device, with a tool holder adapted to carry honing stones for movement along the part surface and driven by a mating part engaging a stationary ring mounted inside the assembly and affixed to the drive spindle housing. The stationary ring has an identical shape to the workpiece being machined to guide and synchronize the tool holder in an eccentric path during the abrading operation and the workpiece and stationary ring are orientated to maintain the synchronous relationship. The apparatus while being rotated is also reciprocated transversely to the workpiece surface causing the stones to move in a helical path.

10 Claims, 6 Drawing Figures

APPARATUS FOR HONING CYCLOIDAL SURFACES

BACKGROUND OF INVENTION

This invention relates to the finishing of unusal shapes by an abrading process and more particularly to the contour honing of a gerotor ring which is used in conjunction with a hydraulic pump or motor.

The gerotor pump also sometimes known as a gear pump or motor has a rotating star shaped element which is slightly offset from the major axis of the unit cooperating with a stator ring. Such a pump or device is shown in two recently issued U.S. Pat. Nos. 4,200,427 and 4,181,479. This particular type pump is also sometimes referred to as a star pump. The typical assembly has a symmetrically shaped element which makes up the rotor portion and a cyclodial shaped element for the stator portion of the active parts of the pump system. In such a device the rotating element has one less tooth form on it than the mating stator thereby causing the center line or axis of the rotor to follow a path which is eccentric to the major axis of the stator. This offset causes a fixed displacement to exist between the rotor and stator. These types of devices used as both pumps and motors have been manufactured for many many years.

The finishing process for the stator in these devices has in the past consisted of a high speed grinding operation in order to achieve a surface finish that will be acceptable to give the efficiency needed to be competitive with a pump or motor of the vane or piston type. An apparatus for finishing epitrochoidal surfaces has been patented in the U.S. by the patentee, Czubak, and issued as U.S. Pat. No. 3,884,789. The system shown in this patent to hone such epitrochoidal shapes utilized, in addition to the eccentric gear driven hone, a method whereby a plating process is simultaneously going on to achieve the desired surface finish. Another U.S. Patent issued to Hoglund, U.S. Pat. No. 3,774,346, shows a honing apparatus for honing epitrochoidal surfaces. In addition, a United Kingdom Pat. No. 957,922 shows a machining method for machining the cylinder surfaces of a rotary piston engine. This shape is an epitrochoidal shape such as machined in the aforementioned patents. The major purpose of these prior art patents was to hone the usnusual shape and improve the surface finish and wear resistance characteristic of the surface so that improved efficiencies of operation could be obtained.

It is the object of my invention to improve the surface finish of a gerotor ring by abrading the internal surface of such a ring by utilizing three equally spaced honing stones. These honing stones will be mounted in a holder such that the whole assembly can reciprocate transversely to the surface of the gerotor ring while the stones are rotating.

It is further the object of this invention to have the honing stone holder assembly mounted on thrust bearings so that it can float while being rotated on an eccentric spindle arrangement and reciprocated transversely thereby imparting a spiral motion to the stones to finish the surface of the gerotor ring lobes.

Further, it is an object of this invention to have the eccentric means synchronized for controlling the path of the abrading tools in relation to the gerotor ring workpiece so that a uniform finish will be achieved on the ring. It is the further object of this invention to have the surfaces of the honing stones countoured in such a way so as to completely finish the projecting lobes of the gerotor ring.

It is a further object of this invention to have the center line or pivot axis of the honing stone tool holder assembly and the tangential face of the honing stone in such a position so as to be pivotally balanced and retained in an operating position and in contact with the workpiece surface. It is another object of this invention to have a biasing means such as collapsing springs to retract the honing stones when the unit is de-energized.

SUMMARY OF INVENTION

According to the present invention, an apparatus is provided in conjunction with a honing machine for operating on a workpiece having an inner surface consisting of a series of equally spaced lobes which form geometrically a cycloidal shaped surface. The apparatus includes a tool holder adapted to carry honing stones for movement along the cycloidal surfaces being driven by a spindle which is synchronously controlled so that an eccentric means associated with the spindle forces the stones to follow the contour of the workpiece. Driving means are associated with the spindle and the housing which not only rotates the tool and its associated honing stones but also reciprocates the stones perpendicular to the body of the workpiece or transversely across the face of the cycloidal surface. The synchronizing means internal to the housing of the unit is in direct relationship with the workpiece so as to always maintain the proper relationship between the honing stones and the workpiece surfaces. The eccentric portion of the spindle is connected to a drive means which follows a fixed ring as the spindle rotates to maintain the synchronization of the honing tool with respect to the workpiece.

DESCRIPTION

Figure 1:
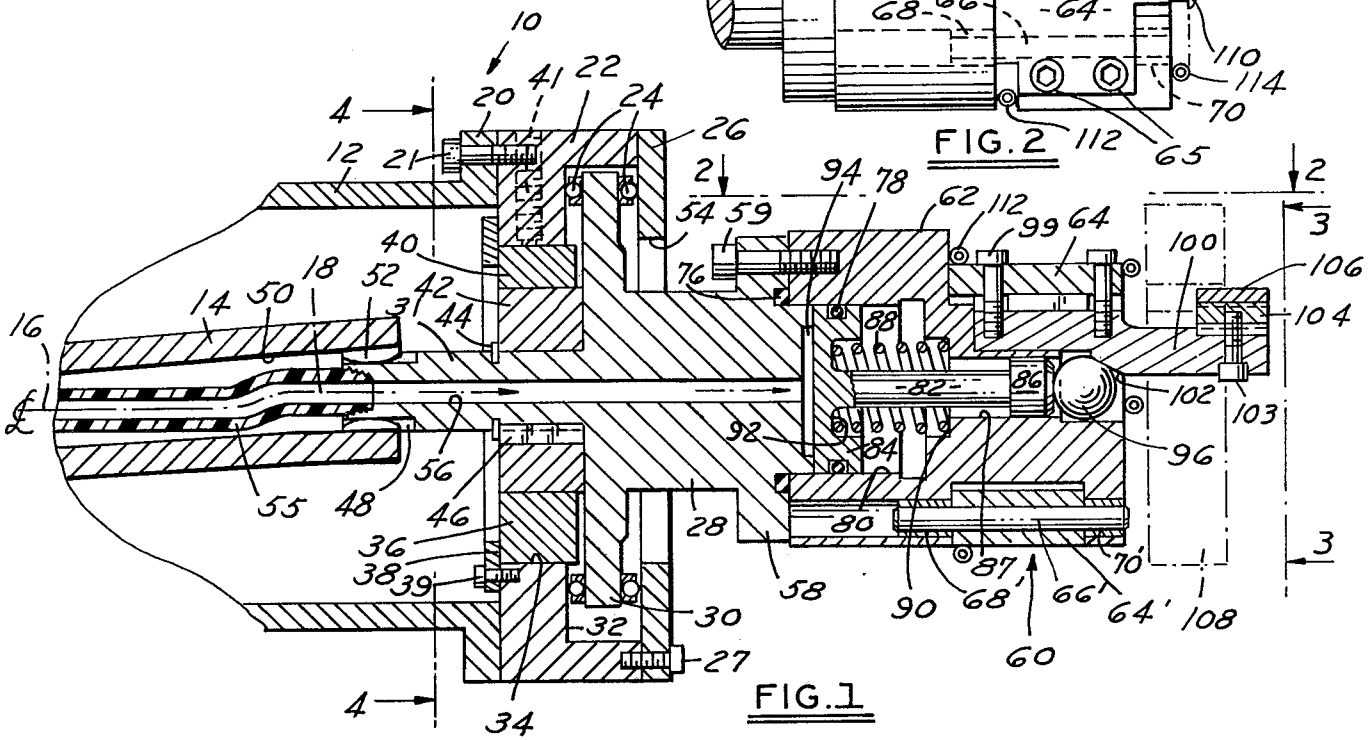
FIG. 1 is a cross-section of the spindle housing and the body of the honing tool and tool holder.

Referring now to the drawings, the preferred embodiment of the abrading apparatus will be described in detail. In FIG. 1 the apparatus generally designated by the numeral 10 is the spindle assembly of a honing machine. This assembly comprises a machine housing 12 which is a reciprocating member attached to the main body of the honing machine which is not shown nor a part of this invention. The machine spindle coupling 14 contained within the housing 12 is coupled to the machine spindle having a main spindle axis 16 about which the abrading tool assembly rotates. The tool assembly is offset and rotates about tool axis 18 on an eccentric path which will be described later. Attached to housing 12 is outer ring adapter 22 which is bolted through flange 20 by bolts 21 which hold the ring adapter 22 to the housing 12. Inner ring body 28 has flanges 30 which ride on thrust bearings 24 internal to ring adapter 22. Bearing plate 26 is attached by screws 27 to outer ring adapter 22 which complete the bearing channel for the thrust bearings 24.

Figure 4:
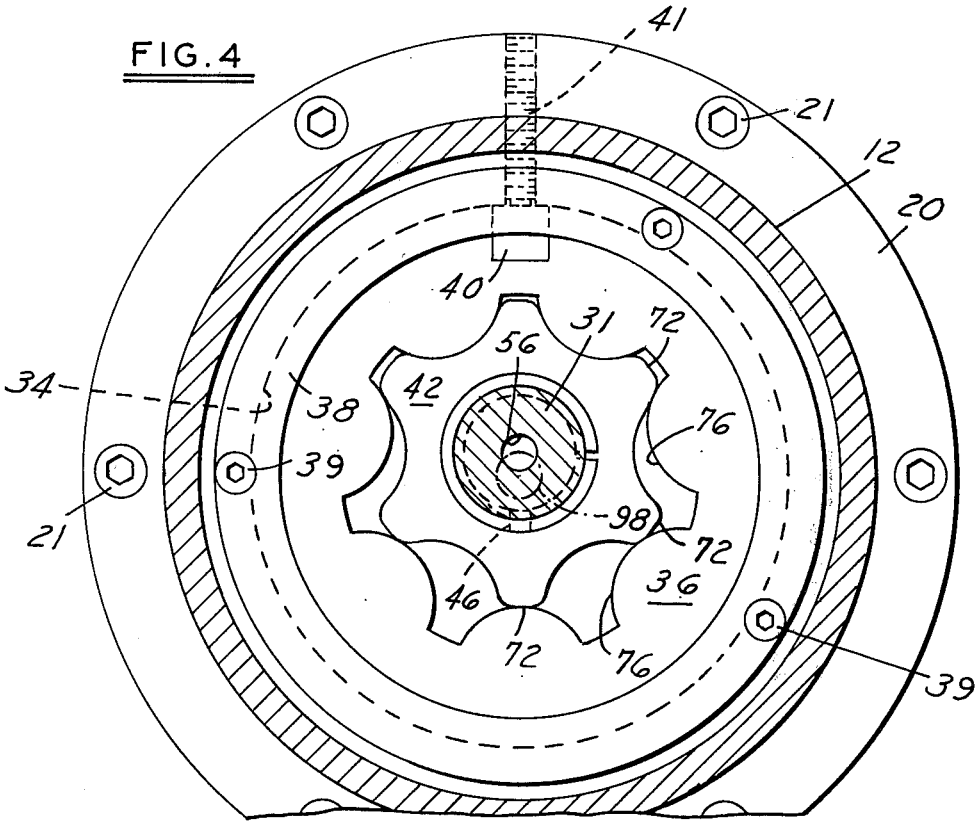
FIG. 4 is a view taken along line 4—4 in FIG. 1.

As the spindle and spindle coupling 14 are rotated, body 28 will rotate in an eccentric with the thrust bearings 24 riding against the inner surface of plate 26 and thrust bearing surface 32 of ring adaptor 22. Spindle coupling 14 is connected to shaft 31, part of body 28, via external spline 48 and internal spline 52 which is part of spindle coupling 14. Referring to FIGS. 1 and 4, outer ring 36 is located in bore 34 of the outer ring adapter 22. Ring 36 is keyed into outer ring adapter 22 by key 40 which is held in place by set screw 41. Retainer 38 is held to outer ring adapter 22 by screws 39 and this retainer 38 holds outer ring 36 in position combined with key 40 which prevents outer ring 36 from rotating. Inner ring 42 is keyed to shaft 31 by key 46 and retaining ring 44 holds inner ring 42 in position on shaft 31.

Figure 2:
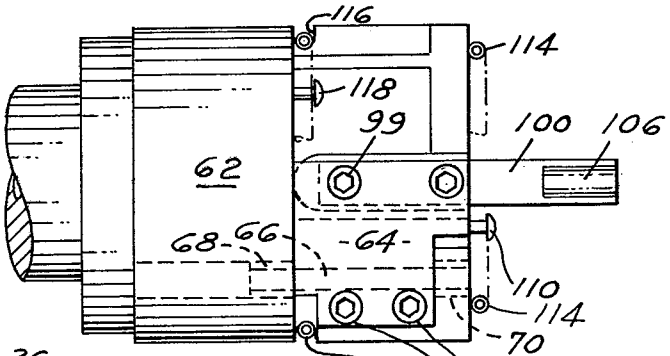
FIG. 2 is a view taken along line 2—2 in FIG. 1.
Figure 3:
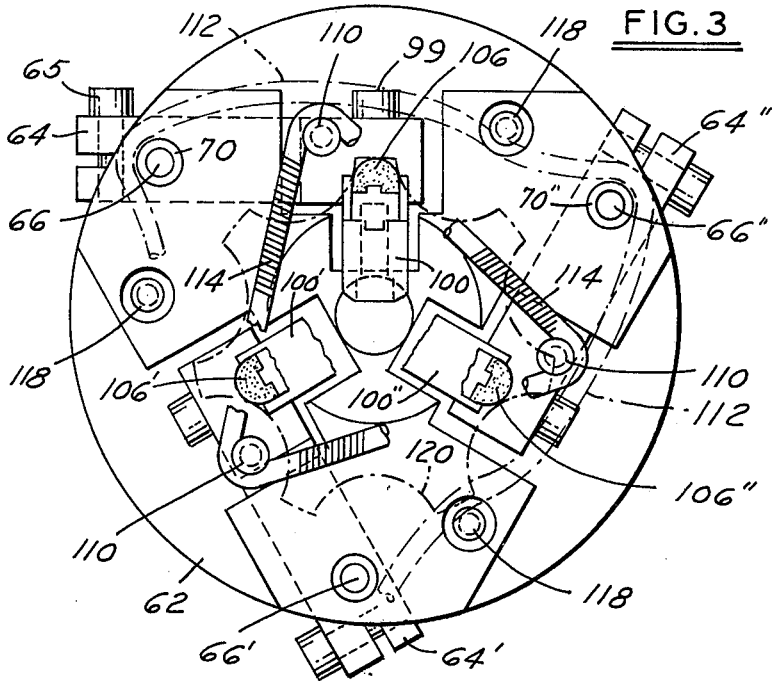
FIG. 3 is a view taken along line 3—3 in FIG. 1.

Tool holder assembly 60 shown in FIG. 1 is held to inner ring body flange 58 by bolts 59. The tool holder assembly 60 as shown in FIGS. 1, 2 and 3 comprise a series of 3 holder assemblies 100, 100', 100" which are each hinged to the tool holder assembly 60. As can be seen in FIG. 3, the preferred embodiment shows the 3 holder assemblies nested in the tool holder 60. Hinge 64 is pinned by pin 66 to the hone body 62 having bushings 68 and 70 (best seen in FIG. 2) at either end of pin 66 allowing the hinge to pivot about this pin. Screws 65 clamp hinge 64 to pin 66. Only a single hinge 64 and its mating parts are discussed but as can be seen the same arrangement is true for the other hinges and parts marked pime (') and double prime ("). Holder assembly 100 as shown in FIG. 1 is attached to hinge 64 by screws 99. The 3 holder assemblies 100, 100', 100" are retained in a retracted or collapsed position by springs 112 and 114 best seen in FIG. 3. Spring retainer 110 holds spring 114 in position and spring retainer 118 holds spring 112 in position in conjunction with groove 116 in body 62 best shown in FIG. 2. The stone assembly consists of stone holder 104 and honing stone 106 which is affixedly held thereto. The stone holder 104 is affixed to hold stone holder assembly 100 by screw 103.

Internal to the hone body 62 and best seen in FIG. 1 is the actuating mechanism for operating the honing stones into honing position. Feed cylinder piston 82 has a head end 84 engaging bore 80 and a rod end 86 engaging bore 87. The feed cylinder piston 82 is held in its de-activated position by spring 88 which is contained in counter bore 90 in hone body 62 and in recess 92 in the feed cylinder piston 82. "O" ring seals 78 and 76 prevent loss of pressure when the unit is activated. Flexible tube 55 and internal ring body bore 56 bring compressed air into recess chamber 94 when the unit is activated. The head end 86 of cylinder piston 82 is in contact with expander sphere 96 which rides against ramp 102 on holder assembly 100. As can be seen in FIG. 1, when the expander sphere 96 is operated, it will force the stone 106 in a radial direction perpendicular to the center line of the tool holder causing it to make contact with the workpiece 108. Similar ramps are engaged on stone holder assemblies 100', 100" so the forces are balanced when the stones 106, 106', 106" engage the workpiece 108. The workpiece 108 is held in a suitable fixture for maintaining its relative position with respect to the tool. Such fixtures are common in the industry and art and do not form a part of this invention.

Figure 5:
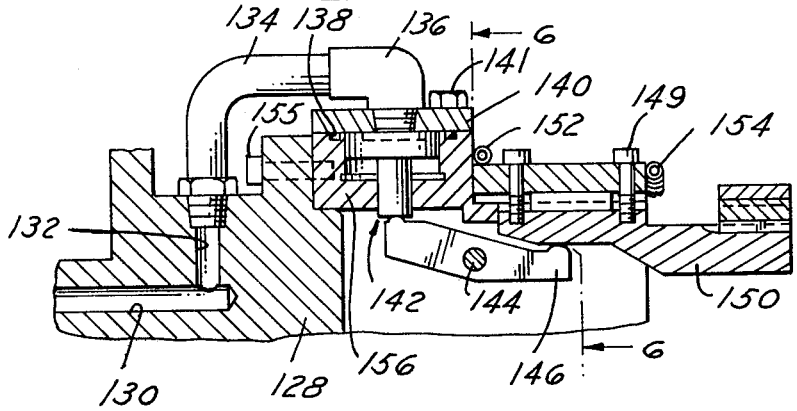
FIG. 5 is a partial embodiment of an individual stone holder and actuating system.
Figure 6:
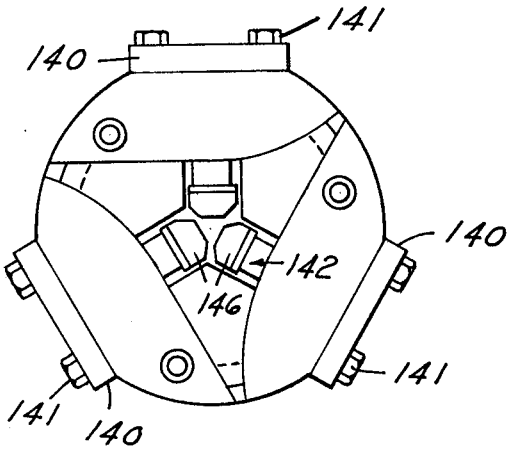
FIG. 6 is a view taken along line 6—6 in FIG. 5.

FIG. 5 is another embodiment of the actuating mechanism. Here, body 128 is shown having hone body 156 held to it by bolt 155. Cylinder piston 142 is shown captured by plate 140 and is affixedly held to body 128 by screws 141. The end of piston 142 contacts pivot arm 146 which is held to body 156 by pivot pin 144 and engages holder assembly 150. Seal 138 holds pressure on feed piston 142 during operation. Bore 130 carries pressurized air through cross bore 132, and through pipe assembly 134 which is connected to elbow 136 which is fixed to plate 140. Springs 154 and 152 act to collapse the assembly when the unit is de-energized.

OPERATION

The operation of the preferred embodiment is best seen in FIGS. 1, 3 and 4. Workpiece 108 is affixedly held in a suitable holder in a fixed relationship to the spindle housing 12 so that the lobes of the parts to be machined or abraded are in proper alignment for the abrading process. The feed cylinder piston 82 is energized causing the expander sphere 96 operating against ramp 102 on holders 100, 100', 100" to move stones 106, 106', 106" radially toward workpiece 108. For ease of discussion only one holder 100 and one stone 106 will be discussed. The trigonal nature of the assembly is such that the operation of all the holders and stones will be the same. As can be seen in FIGS. 3 and 4, the surface 120 to be abraded has the same inner configuration as the outer ring 36, lobe surface 76. The part to be abraded can be seen in position in FIG. 3 as the phantom lines which are touching stones 106, 106', 106". The spindle and spindle coupling 14 are rotated within housing 12 causing driving gear 42 to rotate against outer ring 36 in an eccentric as shown by the circle path 98 in FIG. 4 with the lobes 72 of driving gear 42 making contact between lobe surface 76 of the outer ring 36. This eccentric will cause the stones 106, 106', 106" to follow the cyclodial surface 120 of the workpiece 108 shown in FIG. 3. The contact between the stone and surface will be maintained to hone each lobe of the workpiece 108 as it follows the eccentric path 98 caused by the driving spindle. The thrust bearings 24 are accurately selected so that the translation of the body 28 will be perpendicular to the axis 16 and 18. Compressed air or for that matter any fluid medium will continue to maintain pressure through flexible tube 55 and bore 56 into chamber 94 causing the feed cylinder piston 82 to remain in the engaged position, as viewed in FIG. 1, keeping the expander 96 against ramp 102 of tool holder 100 keeping a constant radial pressure on the tool against workpiece 108. Spring 88 will compress during this time which allows the honing stones 106 to contact workpiece 108. While the spindle is being rotated about axis 16 and the axis 18 is following orbital path 98, the spindle assembly 10 is being reciprocated in a direction coaxial with the spindle axis 16. This will, therefore, cause the stones 106, 106', 106" to move in a reciprocating fashion or transversely across the face of workpiece 108 while simultaneously rotating causing a spiral motion to the stones.

In most honing operations the process will continue with intermittent gaging until the bore is to size. However, because of the shape of this particular workpiece, the operation will be a timed sequence rather than a dimensional measurement of the particular part. This timed operation will be determined as the period necessary to give the best overall surface finish and characteristic for the desired results. Upon completion of the honing operation, the fluid pressure to chamber 94 will be reduced and spring 88 will force feed cylinder 82 to retract. The collapse springs 114 and 112 will cause the honing stones 106, 106', 106" to be disengaged from workpiece 108 and the cycle stopped with the stones out of the workpiece. The workpiece would then be removed from its holding fixture and a new workpiece inserted. As noted earlier, the workpiece would be mounted in a timed or synchronized relationship between the driving inner ring 42 and outer ring 36 so that the correct synchronization between the tool and the workpiece will be achieved. The stone holder 100 as can be seen in FIGS. 1 through 3 are pivoted about pin 66 in bushings 68 and 70. The contour of the stones 106 is determined by the particular size of the ring to be honed and the size of the lobes within the ring. The stone 106 has its cutting surface generally aligned so that a tangential plane across the surface of stone 106 will intersect at the center line of the stone and pass through the center line of pivot pin 66. This has been found to give the best loading characteristic to achieve the desired cutting action and finish results. In FIG. 3 the honing stones 106, 106', 106" can be seen with their respective hinges 64, 64', 64" and stone holder 100, 100', 100". The stone holders and other identical parts are marked with prime numbers but are in reality identical to the unprimed parts, that is, pins 66' and 66" are the same as pin 66.

In summary then, my invention is a honing apparatus for abrading the internal surfaces of a gerotor ring which has a series of three equally spaced honing stones driven by a spindle drive means rotating a tool holding means in an eccentric path determined by the spindle offset, a synchronizing means controls the orbital path of the tool holding means and will maintain the correct abrading contact of the tool to the workpiece for abrading the surface of the workpiece, an actuating means engages and maintains the abrading tool to the workpiece and an axially reciprocating means moves the tool laterally along the workpiece surface to achieve the desired finish on the workpiece, upon completion of the abrading process a means is provided for retracting the tool holders away from the workpiece, and the tool holders are removed from the workpiece.

While the preferred embodiment of the invention describes the honing or abrading process for unusual work surfaces or contours it will be readily appreciated by those skilled in the art that these operations can be performed by an independent or single means and that certain details of this construction may be modified within the concept presented. It is intended, therefore, that the invention is to be limited only by the scope of the claims and reasonably equivalent structures to those defined rather than to the specific details of the apparatus depicted as illustrated herein.

I therefore claim as follows:

1. A honing machine useful for honing a gerotor ring workpiece having a cycloidal shape, comprising housing means movable in reciprocating fashion, spindle means disposed in said housing means for rotation about a spindle axis and reciprocable with said housing means, outer body means affixedly held to said housing means and having a cycloidal shaped outer gear means, and an inner body means coupled to said spindle means and having inner gear means eccentrically rotatable in said outer gear means, said inner body means having a bearing means interacting between said inner body means and outer body means to allow transverse motion of said inner body means perpendicular to the spindle axis during honing, a tool holder assembly means affixedly held to said inner body means having a plurality of tool holder means pivotally held to said assembly means and having an actuating means for urging said tool holder means on an arc toward the workpiece during machining, a retracting means for disengaging said tool holder means from the workpiece.

2. The apparatus of claim 1 wherein said inner body means has a gear means affixed thereto which interacts with a gerotor gear means affixed to said outer body means.

3. The apparatus of claim 2 wherein said spindle means has an off-set axis parallel to said spindle axis to produce an eccentric tool path between said spindle means and said tool holder assembly means.

4. The apparatus of claim 3 wherein said eccentric tool path is synchronized with said workpiece to maintain tool contact between said plurality of tool holder means and said workpiece.

5. The apparatus of claim 4 wherein said actuating means for urging said tool holder means toward said workpiece is a pressurized fluid operated cylinder means coacting with an expander means in working contact with said tool holder means.

6. The apparatus of claim 4 wherein said actuating means for urging said tool holder means toward said workpiece is a plurality of cylinder means operated by a fluid pressure and each coating with one of the plurality of said tool holders means.

7. The apparatus of claim 5 or 6 wherein said retracting means for disengaging said tool holder means after fluid pressure is relieved is a tension spring means in cooperating contact with said tool holder means.

8. The apparatus of claim 7 wherein honing stone means are attached to said tool holder means and traverse in a non-symmetrical spiral path during the honing operation.

9. The apparatus of claim 8 wherein said tool holder means is pivotably affixed to said tool holder assembly means so that a tangential plane across the face of said stone intersecting is center line will pass through the center of th tool holder pivot pin.

10. A honing machine useful for honing a gerotor ring workpiece having a cycloidal shape with a plurality of lobes, comprising housing means movable in reciprocating fashion, spindle means disposed in said housing for eccentric rotation about a spindle axis and reciprocable with said housing means, outer body means affixedly held to said housing means and carrying a gerotor ring gear with a lobed, cycloidal shape corresponding to that of the workpiece and aligned therewith and an inner body means coupled to said spindle means and carrying a star-shaped driving gear rotated eccentrically in said gerotor ring gear, said inner body means having a bearing means interacting between said inner body means and said outer body means to allow transverse motion of said inner body means perpendicular to the spindle axis during honing, a tool holder assembly means affixedly held to said inner body means having a plurality of tool holder means pivotally held to said assembly means and having an actuating means for urging said tool holder means on an arc toward the workpiece during machining, a retracting means for disengaging said tool holder means from the workpiece.

* * * * *